US006666713B1

(12) United States Patent
Norvelle

(10) Patent No.: US 6,666,713 B1
(45) Date of Patent: Dec. 23, 2003

(54) GANGED RECEPTACLE FIXTURE APPARATUS

(76) Inventor: Ronald D. Norvelle, 5375 Air Park Loop West, Green Cove Springs, FL (US) 32043

( * ) Notice: Subject to any disclaimer, the term of this patent is extended or adjusted under 35 U.S.C. 154(b) by 0 days.

(21) Appl. No.: 10/199,563

(22) Filed: Jul. 19, 2002

(51) Int. Cl.[7] ..... H01R 31/08; H01R 13/46; H01H 13/04; H01H 19/04; H01H 21/04

(52) U.S. Cl. ..... 439/507; 174/53

(58) Field of Search ..... 439/507, 510, 439/512, 514, 515, 908, 787, 652, 502; 174/54, 61

(56) References Cited

U.S. PATENT DOCUMENTS

| | | | | | |
|---|---|---|---|---|---|
| 1,790,101 | A | * | 1/1931 | Kohloff | 439/502 |
| 2,588,726 | A | * | 3/1952 | Hoover | 439/189 |
| 2,700,752 | A | | 1/1955 | Cataldo | |
| 3,723,948 | A | | 3/1973 | Wyatt et al. | |
| 3,806,767 | A | * | 4/1974 | Lehrfeld | 361/803 |
| 3,917,371 | A | * | 11/1975 | Hirokawa et al. | 439/52 |
| 4,113,334 | A | | 9/1978 | Instone | |
| 4,165,443 | A | | 8/1979 | Figart et al. | |
| 4,500,152 | A | | 2/1985 | Hammill | |
| 4,669,807 | A | | 6/1987 | Munroe | |
| 4,907,991 | A | * | 3/1990 | Kobayashi | 439/876 |
| 4,958,048 | A | | 9/1990 | Bell | |
| 5,000,699 | A | * | 3/1991 | Nadin | 439/511 |
| 5,415,564 | A | | 5/1995 | Winter et al. | |
| 5,582,522 | A | | 12/1996 | Johnson | |
| 5,601,455 | A | | 2/1997 | Bagga | |
| 5,735,710 | A | | 4/1998 | Blaauboer et al. | |
| 5,777,263 | A | | 7/1998 | Maehler et al. | |

* cited by examiner

*Primary Examiner*—Chandrika Prasad
(74) *Attorney, Agent, or Firm*—Rogers Towers, P.A.; Richard S. Vermut; Matthew W. Bace

(57) ABSTRACT

A gang bus apparatus for rigidly coupling plug receptacles within a receptacle enclosure. In accordance with one embodiment of the present invention, a gang bus apparatus includes at least two discrete plug receptacle modules. Each of the plug receptacle modules includes a front surface disposed substantially co-planar with an opening of a module enclosure, the front surface including electromechanical plug reception means for mating with an electrical plug. Each of the plug receptacle modules further includes an opposing rear surface having at least one electromechanical contact point. A rigid, substantially flat conductive bar is disposed along the rear surfaces of the at least two plug receptacles with the conductive bar coupled to each of the electromechanical contact points to simultaneously provide a rigid structural connection between the plug receptacles and provide a common electrical node between the electromechanical contact points.

12 Claims, 2 Drawing Sheets

GANGED RECEPTACLE FIXTURE APPARATUS

BACKGROUND OF THE INVENTION

1. Technical Field

The present invention relates in general to electrical receptacles and switches encased within receptacle enclosures, and in particular to joining multiple receptacles or switches within an enclosure. More particularly, the present invention relates to a gang bus suitably constructed, and disposed between two or more receptacles or switches within a confined receptacle enclosure.

2. Description of the Related Art

Electrical power is typically supplied to a building from external power lines into a centralized power panel. From the power panel, the supply power is distributed throughout the structure or building by the positioning of outlet or wall enclosures utilized as terminal access points for the power supply system. Such outlet enclosures are typically cavities extending behind the outer surface of a wall having dimensions suitable for retention of electrical receptacles or switches, depending on the application. A receptacle is a static forum for manually coupling "plugs" such as those on power cords to the source power wiring. As deployed within wall enclosures, switches provide a selectable contact point between the source wire supply and fixtures such as lights, appliances, electrical receptacles, etc. Within such wall enclosures, electrical receptacles or switches are mounted behind faceplates that conform to the dimensions of the enclosure opening.

For typical single-phase AC systems, the mounting of receptacles or switches to the source power supplied from the power panel requires connecting supply wire running through the walls and into the enclosure to designated contact points on the receptacles. Due to limited enclosure space, and as will be appreciated by one familiar with such mounting procedures, substantial hand work is required to connect the enclosure source wiring with a receptacle or switch module. The space within a given enclosure becomes even more limited due to the need to coil excess supply-side wire within the receptacle or outlet box behind the individual module.

The need to connect multiple discretely manufactured receptacle or switch modules within a given enclosure arises in situations involving installation or modification of a desired module configuration within an existing enclosure that itself is not available to modification for practical or construction industry standard reasons. A receptacle outlet enclosure situated within a wall, floor, or ceiling cavity is a typical example. In such a situation, two or more discrete modules (e.g. two or more duplex plug receptacles) are mutually coupled to provide a common electrical forum supplied by a single set of supply wires. The modules are subsequently mechanically affixed to pre-designated module anchoring points (e.g. screws anchors) within the enclosure and a faceplate is often affixed to cover the otherwise uncovered area of the enclosure opening.

Conventionally, the mutual electrical coupling between modules within a confined enclosure has been accomplished utilizing jumper wires that extend from the "source" module (i.e. the module to which the supply wire will be directly connected) to the other mutually coupled modules. The addition of one or more jumper wires significantly decreases the room available in the enclosure, thus increasing the difficulty in installation of the supply wires to the source module. In addition, extra handwork is required in situating each of the individual modules in position for anchoring within the enclosure.

It can therefore be appreciated that a need exists for an improved apparatus for installing multiple receptacle or switch modules within a given enclosure. The present invention addresses such a need.

SUMMARY OF THE INVENTION

A gang bus apparatus for rigidly coupling plug receptacles within a receptacle enclosure is disclosed herein. In accordance with one embodiment of the present invention, a gang bus apparatus includes at least two discrete plug receptacle modules. Each of the plug receptacle modules includes a front surface disposed substantially co-planar with an opening of a module enclosure, the front surface including electromechanical plug reception means for mating with an electrical plug. Each of the plug receptacle modules further includes an opposing rear surface having at least one electromechanical contact point. A rigid, substantially flat conductive bar is disposed along the rear surfaces of the plug receptacles with the conductive bar coupled to each of the electromechanical contact points to simultaneously provide a rigid structural connection between the plug receptacles and provide a common electrical node between the electromechanical contact points.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF A PREFERRED EMBODIMENT

This invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the present invention.

The present invention is directed to a gang bus apparatus that provides electrical contact between multiple plug receptacle outlets or fixture switches, while simultaneously providing a rigid mutual coupling of the modules for convenient mounting within a confined receptacle enclosure. As explained herein, the gang bus apparatus of the present invention improves upon conventional jumper wire connectivity by a flat bar design that results in maximizing the space available within a given enclosure and dispensing with the need to manually adjust the mutual positioning of fixture modules within the enclosure.

Figure 1B:
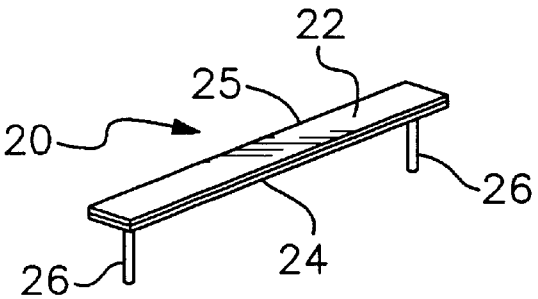
FIG. 1B is an angled perspective view illustrating a push-through receptacle gang bus that may be utilized with a ganged receptacle fixture apparatus in accordance with an alternate embodiment of the present invention.
Figure 1A:
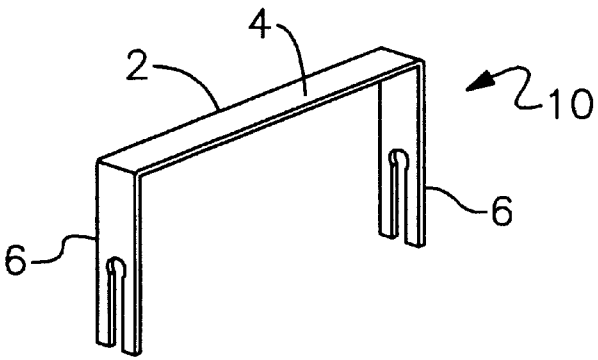
FIG. 1A is an angled perspective view depicting a split-fork receptacle gang bus that may be utilized with a ganged receptacle fixture apparatus in accordance with one embodiment of the present invention.

With reference now to the figures wherein like reference numerals refer to like and corresponding parts throughout, and in particular with reference to FIG. 1A, there is illustrated an angled perspective view depicting a split-fork gang bus 10 that may be utilized with a ganged receptacle fixture apparatus in accordance with one embodiment of the present invention. As shown in FIG. 1A, split-fork gang bus 10 includes a substantially flat rigid axial bar member 2 that is flanged on both distal ends by split-fork contact members 6. In accordance with the present invention, split-fork gang bus 10 is utilized to electrically and mechanically couple at least two discretely manufactured plug receptacle modules or fixture switch modules within a fixture enclosure such as a wall, ceiling, or floor enclosure. For uniformity of reference, plug receptacles and fixture switches will be referred to interchangeably herein as "electrical fixture modules" or simply "fixture modules".

Rigid axial bar member 2 and split-fork members 6 are constructed of a suitably conductive metal such as copper, aluminum, or brass. The material selected must provide sufficient rigidity such that split-fork gang bus 10 is substantially resistant to compressive forces applied at a relatively co-planar angle with respect to a flat top surface 4 at the distal ends of axial member 2. Furthermore, the selected axial bar material must be substantially resistant to axial or shearing forces applied at an angled direction with respect to surface 4 at or near the distal ends of axial member 2. The open ends on split-fork contact members 6 are designed to electromechanically engage fastener members disposed on suitable electrical fixture modules as depicted in further detail below with reference to FIGS. 2A and 2B.

Referring to FIG. 1B, there is depicted an angled perspective view illustrating a push-through gang bus 20 that may be utilized with a ganged receptacle fixture apparatus in accordance with an alternate embodiment of the present invention. As shown in FIG. 1B, gang bus 20 includes a substantially flat rigid axial bar member 25 similar to axial bar member 2. Axial bar member 25 includes a substantially flat top surface 22 and a substantially flat bottom surface 24. In contrast to the bus configuration depicted in FIG. 1A, gang bus 20 includes "push-through" contact members 26, which are solid, non-forked conductive members situated at or substantially near the distal ends of axial bar member 25. Axial bar member 25 and contact members 26 are preferably constructed of suitably conductive metal such as copper or aluminum. As explained in further detail with reference to FIGS. 2A and 2B, push-through contact members are utilized to effectuate contact with receptor contact orifices within fixture modules.

Figure 1C:
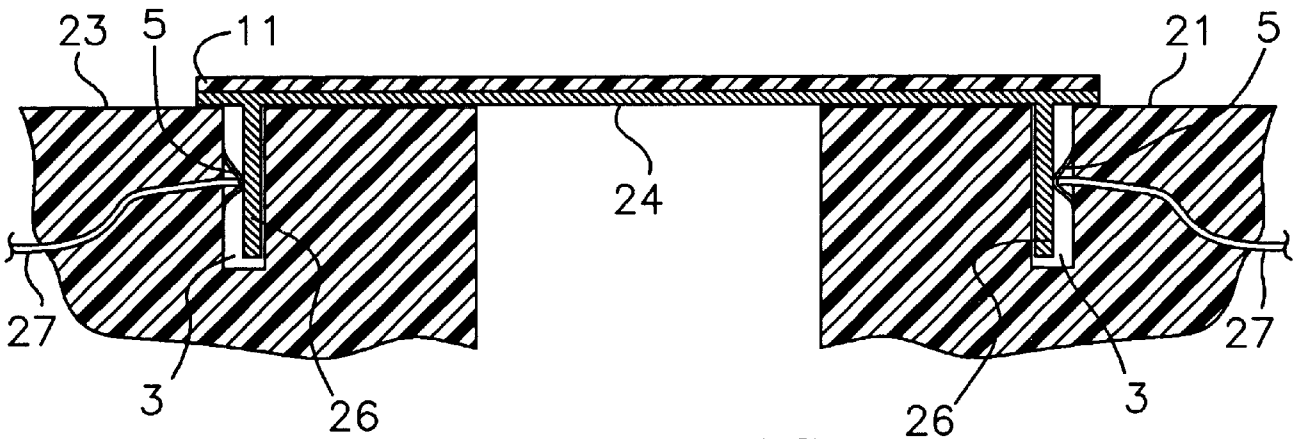
FIG. 1C is a side view of the push-through-receptacle gang bus shown in FIG. 1B as implemented within a ganged receptacle fixture apparatus in accordance with the present invention.

FIG. 1C illustrates a side profile view of push-through gang bus 20 as connectively disposed between two fixture modules in accordance with a preferred embodiment of the present invention. The side profile view reveals additional features of push-through gang bus 20 including a non-conductive surface coating 11 that adhesively coats the top surface 22 of axial bar member 25. Non-conductive surface coating 11 is useful in providing an insulated outer surface that may be safely handled and/or exposed to conductive elements as installed within a given receptacle enclosure. In one embodiment of the present invention, nonconductive coating 11 is color coded (e.g. red, black, white, etc.) to provide a user indication of the voltage or polarity of the corresponding contact engaged by push-through gang bus 20.

The side profile view provided in FIG. 1C depicts push-through gang bus 20 fully engaged with a rear surface 23 of a first module, and a rear surface 21 of a second module, wherein only partial cross-sections of the respective module bodies are shown. As further illustrated in FIG. 1C, push-through gang bus 20 engages each of the respective module bodies by coupling contact members 26 with electromechanical contact means within the respective module bodies. In the depicted embodiment, the electromechanical contact means include a cavity 3 into which contact members 26 are inserted, and contact retention means 5, which is typically a conductive element suitably disposed within cavities 3 to electrically contact and mechanically retain contact members 26 within cavities 3. A conductive element 27 extends from contact retention means 5 to electrically connect contact retention means 5 with the fixture components (e.g. plug receptor contacts) within the object module.

In accordance with the depicted embodiment, contact members 26 are designed to have dimensions (the length in particular) such that upon insertion of contact members 26 into cavities 3, the substantially flat bottom surface 24 of axial bar member 25 is situated in substantial co-planar surface contact with the rear surfaces 21 and 23 of the respective fixture modules. In this manner, the installation of push-through gang bus 20 to connect to or more fixture modules results in a minimum of consumed enclosure space.

Figure 2A:
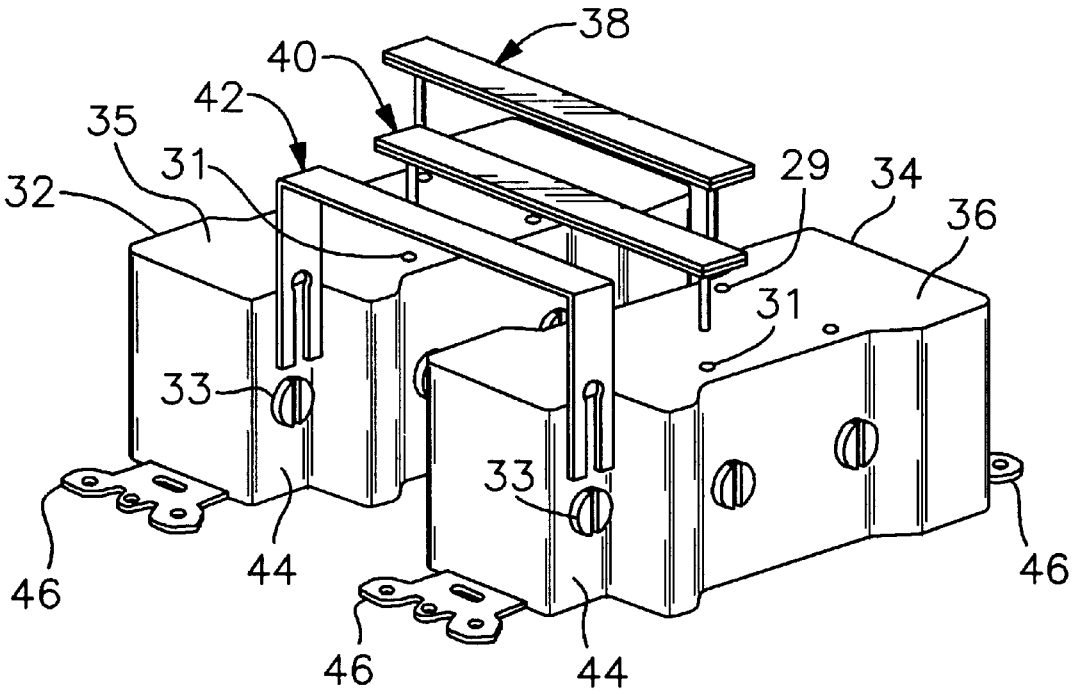
FIG. 2A is an angled perspective rear view of a pair of plug receptacles depicting the deployability of the gang bus mounting apparatus of the present invention.

With reference to FIG. 2A, there illustrated an angled perspective rear view of a pair of plug receptacles depicting the deployability of the gang bus mounting apparatus of the present invention. Specifically, FIG. 2A depicts a pair of discrete module duplex plug receptacles 32 and 34 that may be electromechanically coupled by two push-through gang busses 38 and 40, and a split-fork gang bus 42. Although not explicitly illustrated in FIG. 2A, it can easily be appreciated by users of common duplex plug receptacles that the front surfaces such receptacles include plug receptor means for engageably mating with the male plug means typically disposed on the end of power cords and the like. When installed within a receptacle enclosure (not depicted), the front surfaces of duplex plug receptacles 32 and 34 are disposed substantially co-planar with the enclosure opening.

Push-through gang busses 38 and 40 are fastened across the co-planar opposing rear surfaces 35 and 36 of duplex plug receptacles 32 and 34, respectively, by inserting the contact members (described with reference to FIGS. 1B and 1C) of the push through gang busses into a first and second set of contact receptor cavities 29 and 31. The fastener means for split-fork gang bus 42 comprise conductive split forks protruding as flanges from the distal ends of the axial member as illustrated in FIG. 1A. The conductive split forks have open ends suitable for electromechanically engaging screw-type fastener members 33 situated on side surfaces 44 of duplex plug receptacles 32 and 34.

Within a typical AC power source configuration, duplex plug receptacles 32 and 34 are designed to accommodate three distinct electrical contacts including a positive contact, a negative contact, and a common ground contact (sometimes referred to in the art as the bond contact). Each of gang busses 38, 40, and 42 serve as a common electrical node between the respective contact types (i.e. positive, negative, and ground) included within duplex plug receptacles 32 and 34. In a preferred embodiment of the present invention, the top axial bar surfaces of each of push-through gang busses 38 and 40 includes a non-conductive surface coating that is color coded to indicate the relative polarity or voltage level of the corresponding receptacle contact.

Figure 2B:
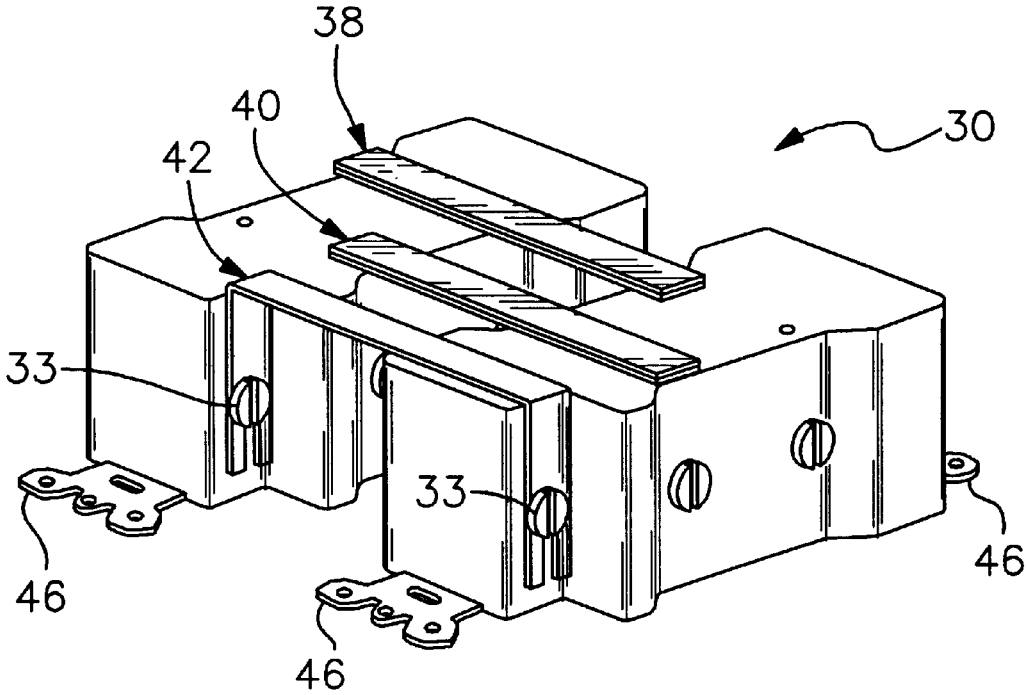
FIG. 2B is an angled perspective rear view of the pair of plug receptacles shown in FIG. 2A in which the gang bus mounting apparatus is deployed in accordance with a preferred embodiment of the present invention.

FIG. 2B provides an angled perspective rear view of plug receptacles 32 and 34 wherein the gang bus mounting apparatus is deployed in accordance with a preferred embodiment of the present invention. Specifically, FIG. 2B illustrates a ganged receptacle 30 resulting from the coupling of duplex plug receptacle 32 to duplex plug receptacle 34 effectuated by push-through gang busses 38 and 40, and split-fork gang bus 42. In an important feature of the present invention, the constituent materials and dimensions of gang busses 38, 40, and 42 effectuate a substantially rigid relative fixation between the duplex receptacles. Ganged receptacle 30 may thus be conveniently installed as a single nonmalleable unit within a suitable receptacle enclosure and fastened thereto utilizing receptacle mounting brackets 46.

The embodiments explained with reference to FIGS. 2A and 2B depicted plug receptacles as the elements joined by the ganged bus apparatus of the present invention. It should be noted, however, that the inventive concept disclosed herein is not limited to such embodiments and other analogous electrical supply termination devices, such as fixture switches, which are also installed within wall, floor, or ceiling enclosures may be utilized in the ganged bus apparatus without departing from the spirit or scope of the present invention.

It is contemplated that equivalents and substitutions for certain elements and components set forth above may be obvious to those skilled in the art, and therefore the true scope and definition of the invention is to be as set forth in the following claims.

What is claimed is:

1. A ganged receptacle fixture apparatus comprising:

at least two fixture modules each having a rear surface opposing a user accessible front surface, said rear surface having at least one push-through contact receptor cavity; and at least two rigid, conductive bars having substantially flat bottom surfaces disposed in surface contact against the rear surfaces of said at least two fixture modules, wherein each of said at least two conductive bars includes push-through contact means extending perpendicularly from the bottom surface thereof and engaging one of the push-through contact receptor cavities such that each of said at least two conductive bars provide rigid mutual coupling and a common electrical node between said at least two fixture modules.

2. The ganged receptacle fixture apparatus of claim 1, wherein each of said at least two rigid, conductive bars include a top surface, said ganged receptacle fixture apparatus further comprising a non-conductive coating covering the top bar surfaces.

3. The ganged receptacle fixture apparatus of claim 2, wherein said non-conductive coating is color coded.

4. The ganged receptacle fixture apparatus of claim 1, wherein said at least two rigid, conductive bars are disposed in surface contact against the rear surfaces of said at least two fixture modules during the manufacturing of said at least two fixture modules.

5. A ganged plug receptacle apparatus comprising:

at least two plug receptacle modules each having:

a rear surface opposing a front plug engagement surface, said rear surface having at least one push-through contact receptor cavity; and a side surface having at least one screw-type electromechanical contact point mounted thereon;

at least one push-through gang bus extending between and in surface contact with the rear surfaces of said at least two plug receptacle modules, said at least one push-through gang bus comprising a rigid, conductive bar member having a substantially flat bottom surface from which push-through pin members perpendicularly extend and engage the push-through contact receptor cavities; and at least one split-fork gang bus extending between and in surface contact with the rear surfaces of said at least two plug receptacle modules, said at least one split-fork gang bus comprising a rigid, conductive bar member terminating at each end with a conductive split-fork flange that removably engages one of the at least one screw-type electromechanical contact points.

6. The ganged plug receptacle apparatus of claim 5, wherein each of the conductive bars are disposed in surface contact against the rear surfaces of said at least two plug receptacle modules during the manufacturing of said at least two plug receptacle modules.

7. The ganged plug receptacle apparatus of claim 5, wherein each of said rigid bar members includes a top surface, said ganged plug receptacle apparatus further comprising a nonconductive coating covering the top bar surfaces of said push-through and split-fork gang buses.

8. The ganged plug receptacle apparatus of claim 7, wherein said non-conductive coating is color coded.

9. A ganged receptacle fixture apparatus comprising:

at least two fixture modules each including a side surface having at least two screw-type electromechanical contact point mounted thereon; and at least two rigid, conductive bars having a substantially flat bottom surface disposed in surface contact against the rear surfaces of said at least two fixture modules, each of said at least two conductive bars terminating at each end with a conductive split-fork flange that removably engages one of the at least two screw-type electromechanical contact points such that each of said at least two conductive bars provides rigid mutual coupling and a common electrical node between said at least two fixture modules.

10. The ganged receptacle fixture apparatus of claim 9, wherein each of said at least two rigid, conductive bars includes a top surface, said ganged receptacle fixture apparatus further comprising a non-conductive coating covering the top bar surfaces.

11. The ganged receptacle fixture apparatus of claim 10, wherein said non-conductive coating is color coded.

12. The ganged receptacle fixture apparatus of claim 9, wherein said at least two rigid, conductive bars are disposed in surface contact against the rear surfaces of said at least two fixture modules during the manufacturing of said at least two fixture modules.

* * * * *